US005257913A

United States Patent [19]

Schwarzer et al.

[11] Patent Number: 5,257,913

[45] Date of Patent: Nov. 2, 1993

[54] HAND TOOL FOR PRODUCING LOCAL OVER OR UNDER PRESSURE

[75] Inventors: Jürgen Schwarzer, Essen; Deenakar Rao, Duisburg, both of Fed. Rep. of Germany

[73] Assignee: Schwarzer Prazision Jurgen Schwarzer GmbH & Co. KG, Essen, Fed. Rep. of Germany

[21] Appl. No.: 781,192

[22] PCT Filed: Apr. 5, 1991

[86] PCT No.: PCT/EP91/00650

§ 371 Date: Dec. 5, 1991

§ 102(e) Date: Dec. 5, 1991

[87] PCT Pub. No.: WO91/16133

PCT Pub. Date: Oct. 31, 1991

[30] Foreign Application Priority Data

Apr. 17, 1990 [DE] Fed. Rep. of Germany ..... 4012256

[51] Int. Cl.[5] ..... F04B 35/04

[52] U.S. Cl. ..... 417/411; 417/234

[58] Field of Search ..... 417/410, 411, 234, 360

[56] References Cited

U.S. PATENT DOCUMENTS

| | | | |
|---|---|---|---|
| 1,927,799 | 9/1933 | Mann | 417/203 |
| 2,635,550 | 4/1953 | Granberg | 417/410 |
| 2,961,129 | 11/1960 | Bullock | 417/411 |
| 3,099,386 | 7/1963 | Pieper | 417/411 |
| 3,468,260 | 9/1969 | Belden | 417/410 |
| 3,576,379 | 4/1971 | Parise | 417/410 |
| 4,257,540 | 3/1981 | Wegmann | 417/411 |
| 4,519,258 | 5/1985 | Takubowicz | 128/DIG. 1 |
| 4,631,006 | 12/1986 | Murray | 417/234 |
| 4,810,173 | 3/1989 | Thomson | 417/411 |
| 4,884,314 | 12/1989 | Miner et al. | 417/411 |
| 4,894,882 | 1/1990 | Toya | 15/344 |
| 4,945,604 | 8/1990 | Miner et al. | 15/344 |
| 5,044,469 | 9/1991 | Liu | 417/410 |
| 5,115,566 | 5/1992 | Zeitlin | 417/411 |

FOREIGN PATENT DOCUMENTS 0338797 10/1989 European Pat. Off. .

*Primary Examiner*—Richard A. Bertsch
*Assistant Examiner*—Peter Korytnyk
*Attorney, Agent, or Firm*—Herbert Dubno

[57] ABSTRACT

A hand tool has an elongated housing, an adapter at one end of the housing, an electric motor in the housing, and a vane pump in the housing flanged directly to and driven by the motor and having an intake. A conduit is connected in the housing between the intake of the vane pump and the adapter. A battery in the housing is connected to the motor to drive same.

1 Claim, 1 Drawing Sheet

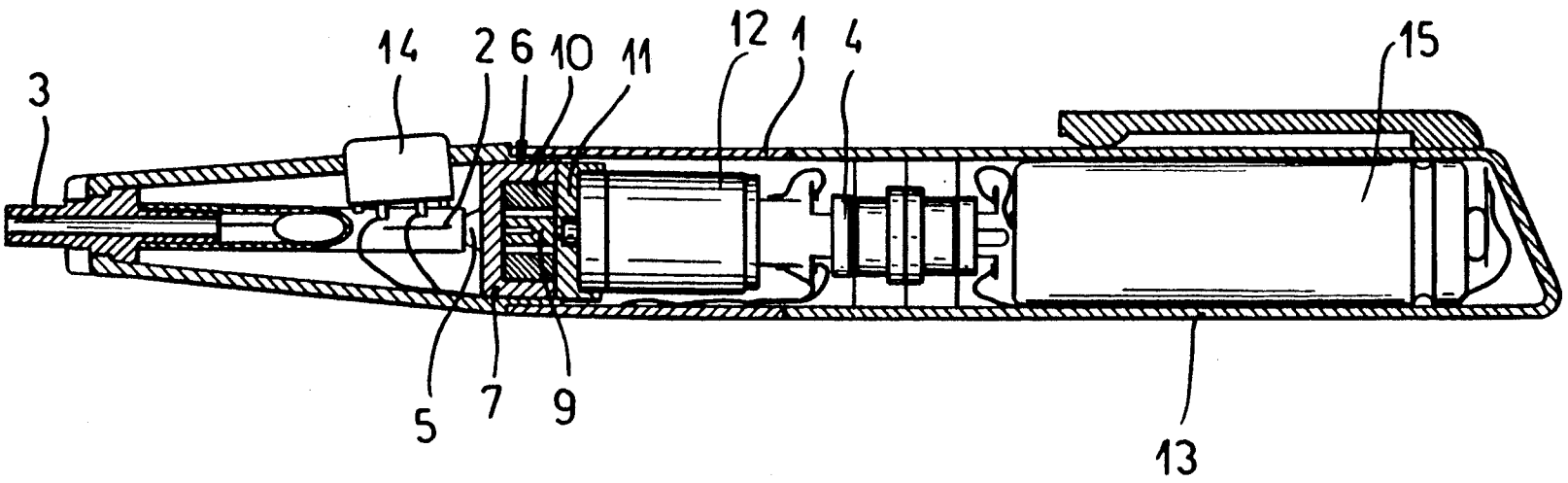
15
13
4
1
12
11
10
6
2
14
3
9
7
5

HAND TOOL FOR PRODUCING LOCAL OVER OR UNDER PRESSURE

FIELD OF THE INVENTION

The present invention relates to a hand tool for producing a local over or under pressure. More particularly this invention concerns such a tool having a housing, an adapter on the housing, a pump connected via a conduit to the adapter, a motor driving the pump, and a power supply for the motor.

BACKGROUND OF THE INVENTION

Such hand tools serve various purposes, e.g. the manipulation of small or extremely small objects such as elements in the electronic, optical, laboratory, and medical fields. In every case the tool should be as simple and easy to handle as possible.

This handling ease is limited in the known such hand tools in that the pump necessary for producing the desired under or over pressure is arranged outside the hand-held tool and is connected to same via a hose or the like. This hose substantially limits the ease of use and range of movement of the hand tool.

OBJECT OF THE INVENTION

It is an object of the invention to provide a hand tool of the described type which is easier to manipulate and move.

SUMMARY OF THE SUMMARY

This object is solved according to the invention by providing the pump and motor inside the housing of the tool. The arrangement of the pump and of the motor inside the tool, which is built to be held in the hand, allows one to dispense completely with feed tubes and the like. As a result the user of the tool is no longer limited by the presence of such tubes.

By providing the electrical power supply inside the housing the hand tool can be completely self-sufficient and constructed without any feed lines whatsoever. Thus the tool is extremely comfortable to use.

The formation of the pump as a vane pump according to the invention makes possible a particularly simple and light construction of the pump and thus a particularly low weight of the tool. In addition the vane pump has shown itself to be particularly well adapted for the desired purposes.

A particularly space-saving mounting of the motor inside the hand tool is possible according to the invention by flanging the motor directly on the vane pump.

According to the invention the hand tool is in a simple manner adaptable to a large number of applications without particular cost.

The separable construction of the housing according to the invention permits a continuous use of the expensive main part containing the motor and the pump so that the power supply that is not also being used can be charged.

Preferably the vane pump can be made in the dimensions of 18 mm outside diameter (preferably 13.5 mm) and 30 mm length (preferably 16 mm) so that it can be built into relatively slim hand tools without problems.

BRIEF DESCRIPTION OF THE DRAWING

The above and other objects, features, and advantages of the invention will become more apparent with reference to the accompanying drawing which is a large-scale axial section through the tool of the present invention.

SPECIFIC DESCRIPTION

The hand tool shown in the figure has a housing 1. The front end of the housing 1 is provided with an adapter 3. This adapter 3 is connected to an input port 5 of a vane pump via a conduit or hose 2 inside the housing. The outside diameter of the vane pump 6 is 13.5 mm and is thus slightly smaller than the inside diameter of the housing 1 whose outside diameter is at most about 17 mm. The vane pump 6 has a housing 7 defining a chamber. The chamber is eccentric to a rotor 9 which is provided at equispaced intervals about its periphery with axially extending slits in each of which is a radially shiftable slide 10. In use of the pump 6 the outer edge of each slide lies on the wall of the chamber. The eccentric orientation of the chamber wall relative to the rotor 9 creates a pressure change on rotation of the rotor 9 corresponding to the change in volume of each chamber portion delimited angularly by two slides 10 and this pressure change is communicated via the input port 5 and the hose 5 to the adapter 3 and thence to the opening of a not illustrated nozzle fitted to the adapter 3.

The rear side of the vane pump 6 turned away from the adapter 3 is closed by a cover plate 11. A motor 12 is flanged onto this cover plate 11 and has an output shaft carrying the rotor 9 of the vane pump 6. The motor 12 is supplied with energy from a battery 15 chargeable through a charging sleeve, the battery being connectable to the motor through a coupling pin 4 and forming part of a power supply 13. The battery 15 can be connected via connections and terminals with a potentiometer whose variable resistance is settable by a control knob. Adjustment of the control knob changes the rotation speed of the vane pump 6 so that the pressure at the opening of the nozzle 3 is controlled. An on/off switch 14 turns the vane pump on and off.

The shown embodiment of the hand tool has a maximum outside diameter of 17 mm and a length of 155 mm.

We claim:

1. A hand tool comprising:

an elongated housing shaped to be held in the hand and having two separable parts;

an adapter at one end of the housing in one of the parts;

an electric motor in the one part of the housing;

a vane pump in the one part of the housing flanged directly to and driven by the motor and having an intake;

a conduit connected in the one part of the housing between the intake of the vane pump and the adapter; and an electrical battery in the other part of the housing separably connected to the motor to drive same, whereby the battery housing part can be switched with one with a fresh battery.

* * * * *